US007614164B2

(12) United States Patent
Morales et al.

(10) Patent No.: US 7,614,164 B2
(45) Date of Patent: Nov. 10, 2009

(54) SHOE WITH PADDED SOLE

(75) Inventors: Gabriel Morales, Laguna Hills, CA (US); Albert Silvera, Manhattan Beach, CA (US)

(73) Assignee: Seychelles Imports, LLC, Gardena, CA (US)

( * ) Notice: Subject to any disclaimer, the term of this patent is extended or adjusted under 35 U.S.C. 154(b) by 490 days.

(21) Appl. No.: 11/279,087

(22) Filed: Apr. 7, 2006

(65) Prior Publication Data

US 2007/0234590 A1 Oct. 11, 2007

(51) Int. Cl.
*A43B 13/41* (2006.01)
*A43B 13/42* (2006.01)

(52) U.S. Cl. ..... 36/76 C; 36/76 R; 36/30 R; 36/24.5

(58) Field of Classification Search ..... 36/28, 36/76 R, 24.5, 25 R, 76 C, 30 R
See application file for complete search history.

(56) References Cited

U.S. PATENT DOCUMENTS 2,081,226 A * 5/1937 Coeozella ..... 36/19 R
4,429,473 A 2/1984 Blumenstein
4,866,860 A * 9/1989 Blissett et al. ..... 36/28
5,101,579 A 4/1992 Terlizzi et al.
5,416,989 A 5/1995 Preston
5,435,077 A * 7/1995 Pyle ..... 36/76 R
5,435,078 A * 7/1995 Pyle ..... 36/30 R
5,768,803 A 6/1998 Levy
6,745,498 B2 6/2004 LaDuca
7,047,669 B2 * 5/2006 Polcek ..... 36/25 R
2004/0045191 A1 3/2004 LaDuca

FOREIGN PATENT DOCUMENTS

CA 2478749 2/2006
DE 8904745 U 6/1989
WO WO2006/035469 4/2006

OTHER PUBLICATIONS

European Search Report for corresponding European patent application EP 1 842 443 A3.

* cited by examiner

*Primary Examiner*—Ted Kavanaugh
(74) *Attorney, Agent, or Firm*—Joseph G. Swan, P.C.

(57) ABSTRACT

Provided is a shoe that has a multi-layered sole with embedded padding. More specifically, at least one of the layers includes a sheet of base material having a hole through its central region, such that the hole is surrounded by the base material, and a cushioning pad attached to the base material so as to fill the hole. In one representative embodiment, the cushioning pad is approximately the same size and shape as the hole, and the perimeter of the pad is stitched to the perimeter of the hole. As a result of such construction, padding is provided in a manner that tends to resist damage over time.

12 Claims, 2 Drawing Sheets

SHOE WITH PADDED SOLE

FIELD OF THE INVENTION

The present invention pertains to footwear and is particularly applicable to a shoe having a sole with embedded padding and an elevated heel.

BACKGROUND

A variety of different structures exist for the construction of a shoe's sole. However, improvements in existing structures still are desirable. For example, the present inventor has discovered that problems often have arisen when a designer has attempted to include padding in the sole of a shoe, particularly if the sole is very thin.

SUMMARY OF THE INVENTION

The present invention addresses this problem by providing a shoe that has a multi-layered sole with embedded padding. More specifically, at least one of the layers includes a sheet of base material having a hole through its central region, such that the hole is surrounded by the base material, and a cushioning pad attached to the base material so as to fill the hole. In one representative embodiment, the cushioning pad is approximately the same size and shape as the hole, and the perimeter of the pad is stitched to the perimeter of the hole. As a result of such construction, padding is provided in a manner that tends to resist damage over time.

The foregoing summary is intended merely to provide a brief description of the general nature of the invention. A more complete understanding of the invention can be obtained by referring to the claims and the following detailed description of the preferred embodiments in connection with the accompanying figures.

DESCRIPTION OF THE PREFERRED EMBODIMENT(S)

Figure 1:
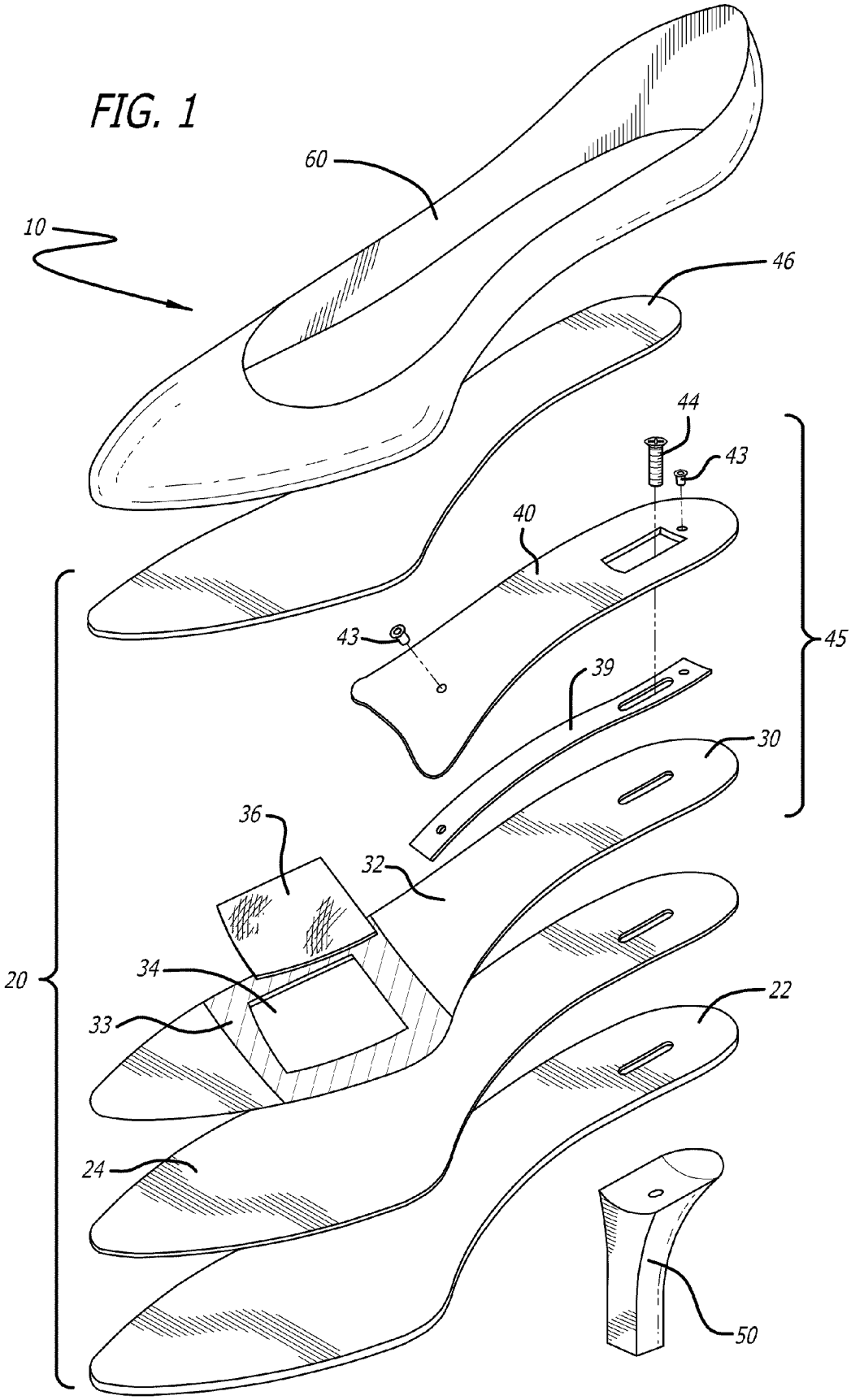
FIG. 1 is an exploded view of a shoe according to a representative embodiment of the present invention.
Figure 2:
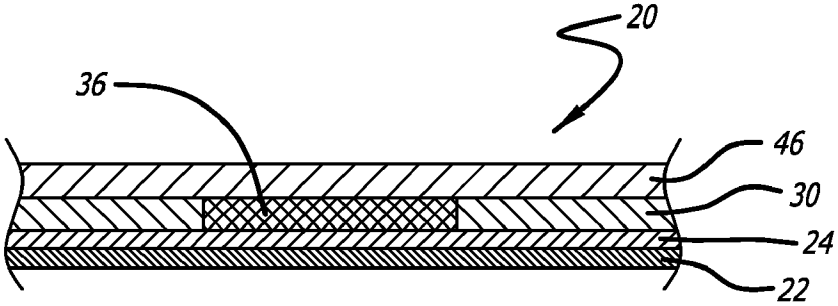
FIG. 2 is a cross-sectional view of the front portion of a shoe sole according to a representative embodiment of the present invention.
Figure 3:
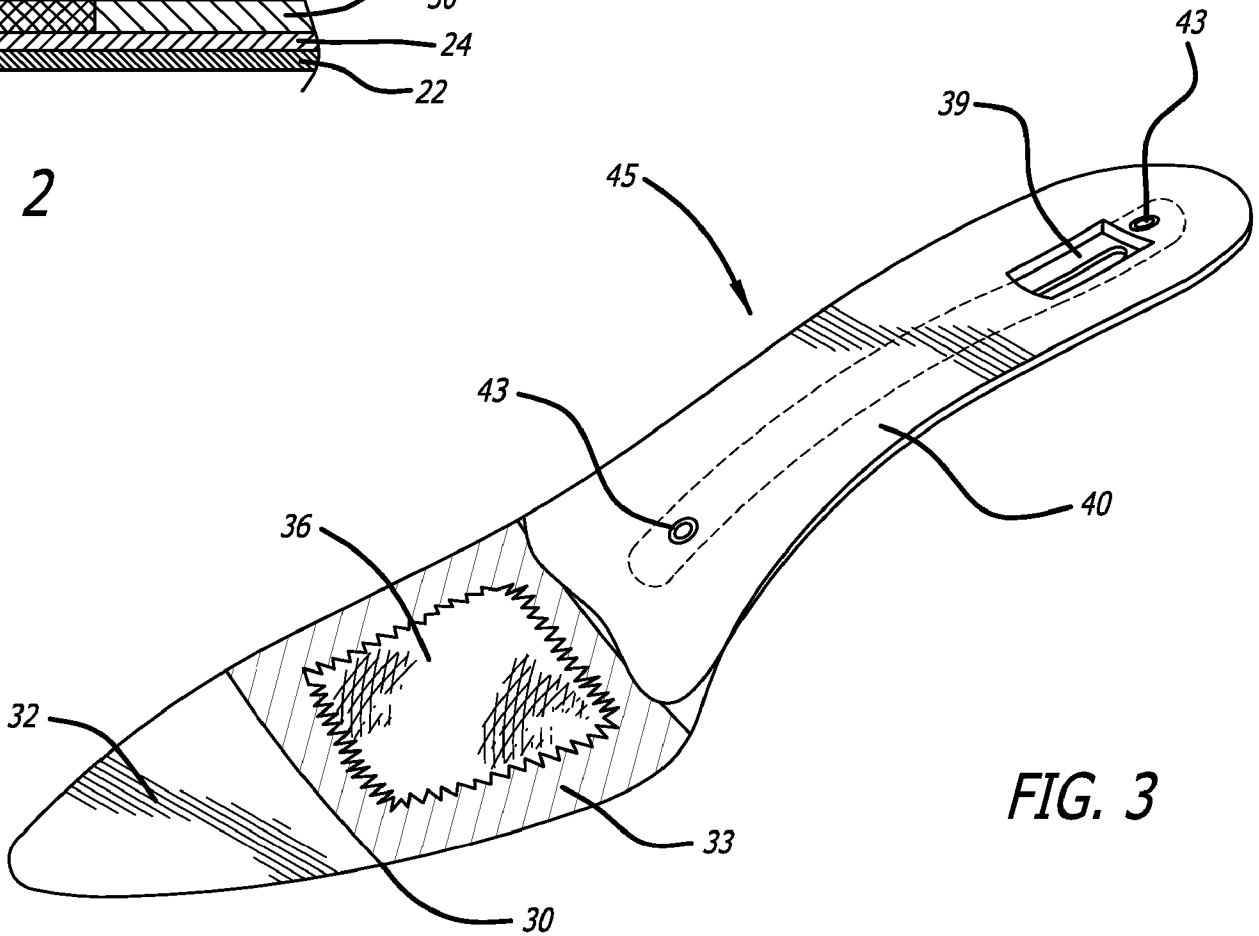
FIG. 3 is a perspective view of a shoe's midsole according to a representative embodiment of the present invention.

The following discussion describes a shoe 10 according to a representative embodiment of the present invention. As shown in the drawings, shoe 10 includes a sole 20, a heel 50 and an upper 60. In accordance with customary styles, a shoe having a separate heel 50 often also will have a very thin sole 20.

Referring initially to FIG. 1, the sole 20 of shoe 10 includes a plurality of layers. The bottom layer, or outsole, 22 preferably is made of natural or synthetic leather, but instead may be made of any other material, preferably one that is sufficiently durable for extended outdoor use, adequately shape-retaining, but still resilient enough to provide a desired amount of comfort. Next is a padding layer 24 which, e.g., may be 1 mm (millimeter) thick of padding filler.

On top of padding layer 24 is an insole board 30 which preferably is comprised of a base material 32, such as 2 mm thick serrated cardboard. Preferably, a region of insole board

30 (more preferably, the metatarsal region) is coated with a thin layer of material 33, which preferably is glued or otherwise bonded onto the base material 32. In the preferred embodiments of the invention, material 33 is a fabric or fibrous material, although other types of material instead may be used. Although not shown in the drawings, layer 33 preferably is applied to both the top and bottom sides of insole board 30.

Cut into the base material 32 and the coating 33 (if provided), again preferably in the metatarsal region of insole board 30, is a hole 34. As shown, hole 34 preferably is almost as wide as insole board 30 and generally covers the entire metatarsal region. In the present embodiment, hole 34 is approximately rectangular, although other shapes instead may be used.

A cushioning pad 36 is provided and preferably is attached around its entire periphery to corresponding points around the periphery of hole 34. In the preferred embodiments, cushioning pad 36 is stitched to the base material 32 around the perimeter of hole 34. The use of an appropriate coating 33 (e.g., fabric or a fibrous material) often can increase the durability of the attachment created by such stitching. However, if the base material 32 itself is sufficiently durable (e.g., made from leather or synthetic leather), a separate coating 33 might not provide much additional benefit.

In any event, cushioning pad 36 preferably is approximately the same size and shape as hole 34, at least in terms of length and width. More preferably, cushioning pad 36 is just slightly smaller in length and width than hole 34 so as to match and just fit within the hole 34. However, because the material forming cushioning pad 36 preferably is more compressible than the base material 32, it often will be desirable to use a cushioning pad 36 that is thicker than the surrounding base material 32 in its ordinary (i.e., uncompressed) state, but which compresses to approximately the same thickness as (or slightly thicker than) base material 32 when the expected amount of weight is applied (e.g., the weight of the expected wearer, or some multiple thereof to account for the extra force produced when the wearer is walking or running). Pad 36 may be formed of any desired cushioning material, such as a gauze-like fabric.

As a result of the foregoing construction, additional cushioning often can be provided where it is needed most, particularly with respect to shoes having elevated heels (such as heel 50). At the same time, the way in which cushioning pad 36 is provided (e.g., within a cut out hole, within a very thin layer of a shoe's sole and/or with 360° peripheral attachment) often can prevent or reduce shifting and/or deterioration of the cushioning pad 36. In this regard, the present inventor has discovered that conventional structures for embedding cushioning in the sole of a shoe often do not provide adequate support to the cushion itself. As a result, the forces applied to such conventional cushioning often will dislodge or damage the cushioning. Such forces typically are applied, e.g., in the ordinary course of walking or running, and particularly include front-to-rear and rear-to-front forces. In contrast, it is believed that the structures of the present invention will tend to significantly reduce such problems.

Immediately above insole board 30 is a relatively thin and elongated shank 39 that preferably is formed from steel or a similar strong, rigid, but somewhat flexible metal or other material, thereby providing additional strength and support and helping to transfer or distribute weight to the heel and forepart of shoe 10. Examples of some of the alternate materials that may be used in shank 39 include polyvinyl chloride (PVC), acrylonitrile butadiene styrene (ABS) a hard thermoplastic rubber (TPR) or any other stiff, and bend-resistant plastics or other materials. In the present embodiment, shank 39 is formed as an elongated substantially rectangular piece. However, other shapes instead may be used to achieve different results.

Immediately above shank 39 is rear midsole portion 40, which preferably is formed of a thicker and/or more bend-resistant and durable material than insole board 30, such as a hard polymer. During construction, the rear midsole portion 40 is bonded to insole board 30, sandwiching shank 39 between them. In addition, rivets 43 are used to further secure shank 39 to the rear midsole portion 40 and, in certain embodiments, to insole board 30. The entire combination of insole board 30, shank 39 and rear midsole portion 40 comprises the shoe's midsole 45.

Above the midsole 45 is another padding layer 46 which, e.g., may be 5 mm thick of latex padding or any other cushioning or padding layer. Padding layer 46 may or may not include a protective and/or more comfortable outer layer. Padding layer 46 directly contacts the wearer's foot and sometimes is referred to as the sock.

Upper 60 may be, e.g., any conventional upper and accordingly may be formed of natural or synthetic leather or any other natural or synthetic material. Although shown in the drawings as having a closed construction, it should be understood that upper 60 instead may have any open or sandal-like construction.

Heel 50 typically is rigid and may be similar or identical to conventional heels. Typically, heel 50 will elevate the rear portion of shoe 10 by anywhere from 1-4 inches. In the preferred embodiments, heel 50 elevates the rear portion of shoe 10 by at least 2 inches.

In order to complete the construction of shoe 10, outsole 22, padding layer 24 and midsole 45 may be joined together using stitching, gluing or any combination of the two. Thereafter, the heel 50 is attached by inserting a screw 44 through matching holes in midsole 45, padding layer 24, outsole 22 and heel 50. In addition, extra padding (not shown) may be provided at the position on midsole 45 that is immediately above where heel 50 attaches to it. In any event, padding layer 46 is then attached, e.g., using adhesive material. Finally, the upper 60 is attached, again using stitching, gluing or any combination. In one representative embodiment, upper 60 is provided with a lip (not shown) that extends between layers of the sole 20. Accordingly, the bonding of the various layers of sole 20 also results in the bonding of upper 62 the sole 20.

The use of the padding structure according to the present invention is particularly applicable to a shoe having an elevated heel, such as shoe 10 shown in the drawings. Such a shoe 10 typically will have a fairly thin sole portion, e.g., with the front portion of the sole being less than ½ inch or even less than ¼ inch thick.

Additional Considerations.

Several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Similarly, in the discussion above, functionality sometimes is ascribed to a particular module or component. However, functionality generally may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

What is claimed is:

1. A shoe, comprising:

a sole comprised of a plurality of layers and having a front portion and a rear portion; and a heel attached to the rear portion of the sole, wherein the plurality of layers includes an insole board, wherein the insole board comprises a sheet of base material having a hole through its central region, such that the hole is surrounded by the base material, and wherein a cushioning pad is attached to the base material so as to fill the hole in the insole board.

2. A shoe according to claim 1, wherein the cushioning pad has a size and shape that at least approximately match a size and shape of the hole.

3. A shoe according to claim 2, wherein the cushioning pad is slightly smaller in length and width than the hole.

4. A shoe according to claim 1, wherein the cushioning pad and the hole are disposed at a metatarsal region of the sole.

5. A shoe according to claim 1, wherein the insole board is a middle layer of the sole.

6. A shoe according to claim 1, wherein the sole further comprises a rigid shank, to which the heel is attached.

7. A shoe according to claim 1, wherein the cushioning pad is stitched to the base material.

8. A shoe according to claim 1, wherein the heel is rigid and narrow such that the rear portion of the sole is elevated above ground level in ordinary use.

9. A shoe according to claim 8, wherein the heel elevates the rear portion of the sole at least 2 inches above ground level.

10. A shoe according to claim 1, wherein the front portion of the sole is less than ¼ inch thick.

11. A shoe according to claim 1, wherein the front portion of the sole is less than ½ inch thick.

12. A shoe according to claim 1, wherein the cushioning pad is securely attached around its entire perimeter to corresponding points around a perimeter of the hole.

* * * * *